US012503281B2

(12) United States Patent
Borjanin et al.

(10) Patent No.: US 12,503,281 B2
(45) Date of Patent: Dec. 23, 2025

(54) VACUUM STOPPER AND ASSEMBLY OF STOPPER AND CONTAINER

(71) Applicant: Airtender Works B.V., Zoetermeer (NL)

(72) Inventors: Dalibor Borjanin, Nieuwerkerk aan den IJssel (NL); Robert Franciscus Van Der Hulst, Leiden (NL); Rui Medeiros Santos, Rotterdam (NL)

(73) Assignee: Dosen-Zentrale Zweigniederlassung der Kölner Blechwarenfabrik Züchner GmbH, Hilden (DE)

( * ) Notice: Subject to any disclaimer, the term of this patent is extended or adjusted under 35 U.S.C. 154(b) by 250 days.

(21) Appl. No.: 17/695,984

(22) PCT Filed: Sep. 17, 2020

(86) PCT No.: PCT/NL2020/050573
§ 371 (c)(1),
(2) Date: Mar. 16, 2022

(87) PCT Pub. No.: WO2021/054825
PCT Pub. Date: Mar. 25, 2021

(65) Prior Publication Data

US 2024/0043184 A1 Feb. 8, 2024

(30) Foreign Application Priority Data

Sep. 18, 2019 (NL) ..... 2023843

(51) Int. Cl.
*B65D 47/20* (2006.01)
*B65D 41/04* (2006.01)
*B65D 51/16* (2006.01)

(52) U.S. Cl.
CPC ..... *B65D 47/2031* (2013.01); *B65D 41/0414* (2013.01); *B65D 51/1644* (2013.01)

(58) Field of Classification Search
CPC ..... B65D 47/2031; B65D 41/0414; B65D 51/1644; B65D 51/24; B65D 2539/003;
(Continued)

(56) References Cited

U.S. PATENT DOCUMENTS 2,758,737 A 8/1956 Hennings
3,057,502 A * 10/1962 Wood ..... B65D 39/0023 215/355

(Continued)

FOREIGN PATENT DOCUMENTS

CN 1214952 C 8/2005
DE 19624588 A1 1/1998

(Continued)

OTHER PUBLICATIONS

International Search Report and Written Opinion—PCT/NL2020/050573—mailing date Nov. 2, 2020.

*Primary Examiner* — James N Smalley
(74) *Attorney, Agent, or Firm* — Banner & Witcoff, Ltd.

(57) ABSTRACT

Vacuum stopper and assembly of stopper and container. There is disclosed a vacuum stopper (1) configured to be positioned into a neck (9) the neck of the bottle, the stopper comprising: a resilient shoulder (4) provided at an upper end of the elongated body (2), wherein the resilient shoulder is arranged for resting onto an upper side of the neck of the bottle; a stop ring (5) provided at an upper end of the elongated body above the resilient shoulder; a valve arranged (6) inside of the elongated body for allowing, in use, air to be sucked out of the container.

21 Claims, 16 Drawing Sheets

Figure 1A:
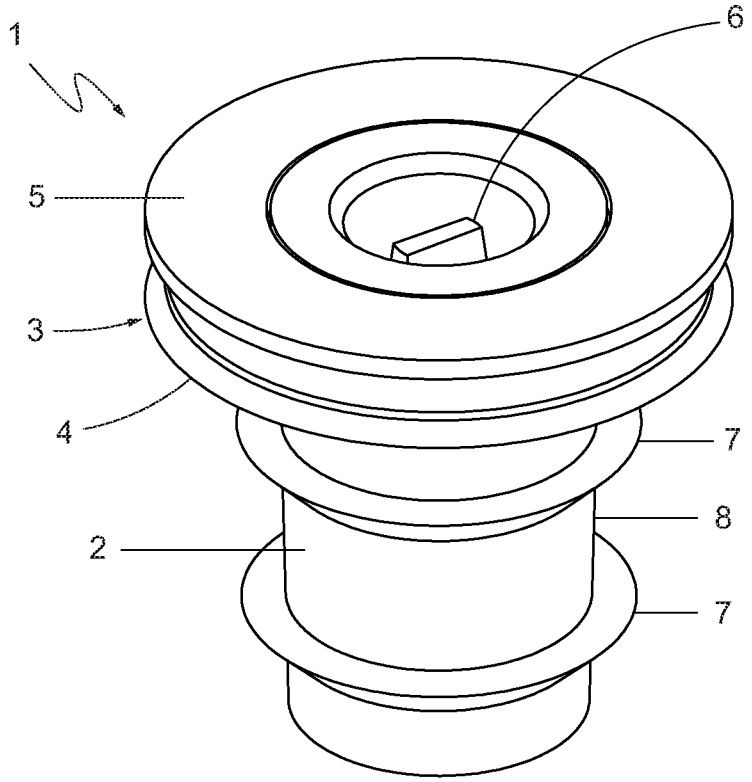

(58) Field of Classification Search
CPC ..... B65D 39/0076; B65D 81/2015; B65D 79/0087
See application file for complete search history.

(56) References Cited

U.S. PATENT DOCUMENTS

| | | | | | |
|---|---|---|---|---|---|
| 4,723,670 | A | | 2/1988 | Robinson et al. | |
| 4,998,633 | A | | 3/1991 | Schneider | |
| 5,823,372 | A | * | 10/1998 | Levine | B65B 31/047 215/355 |
| 2003/0047531 | A1 | | 3/2003 | Wong | |

FOREIGN PATENT DOCUMENTS

| | | | |
|---|---|---|---|
| DE | 102011009494 | A1 | 8/2011 |
| FR | 67096 | E | 11/1957 |
| FR | 2829471 | A1 | 3/2003 |
| GB | 854571 | A | 11/1960 |
| JP | S4966863 | U | 6/1974 |
| JP | S5363346 | U | 5/1978 |
| JP | H0462639 | A | 2/1992 |
| JP | 3064397 | U | 1/2000 |
| WO | 2007068011 | A1 | 6/2007 |

* cited by examiner

VACUUM STOPPER AND ASSEMBLY OF STOPPER AND CONTAINER

CROSS-REFERENCE TO RELATED APPLICATIONS

This application is a U.S. National Stage application under 35 U.S.C. § 371 of International Application PCT/NL2020/050573 (published as WO 2021/054825 A1), filed Sep. 17, 2020, which claims the benefit of priority to Application NL 2023843, filed Sep. 18, 2019. Benefit of the filing date of these prior applications is hereby claimed. Each of these prior applications is hereby incorporated by reference in its entirety.

The invention relates to a vacuum stopper for a container, in particular for a container such as a wine bottle.

Vacuum stoppers are widely used and available in various arrangements and sizes. The vacuum stopper is usually available in combination with a dedicated vacuum pump.

A typical vacuum stopper has a tapered body for insertion into the neck of the container. The tapered body provides for accommodation of various sizes of inner diameters of the neck of the containers. The body has a head portion in which the valve is provided. The head is compatible with the dedicated pump. Due to the contact between the tapered body and the neck of the bottle, a vacuum sealing can be obtained.

A drawback of these known stoppers is that they may be rather bulky and/or may have a large head. The head may make the bottle rather high which makes it difficult that the bottle, with the stopper, is stored in a conventional storage element such as a refrigerator. Further, a bottle with a conventional stopper may not be suitable for horizontal storage as there is a risk on fluid spillage and/or accidentally undoing of the vacuum. Due to the protruding head and/or the bulky appearance, users, in particular professional users, such as restaurant holders etc. are reluctant to use to the stopper as it may deteriorate the view on their visible wine bottle stock. Such a conventional stopper may also be prone to accidentally undoing of the vacuum, e.g. when handling the vacuumed bottle, but there may be no visible indication of the vacuum on the stopper. Also, the spread in diameter of the neck of a wine bottle increases and a conventional stopper may not be able to accommodate a larger diameter spread.

So, there is a need for an improved vacuum stopper that obviates at least one of the above mentioned drawbacks.

Thereto, according to a first aspect of the disclosure there is provided for a vacuum stopper configured to be positioned into a neck of a container for closing the container and allowing the container to be vacuumed, the vacuum stopper comprising: an elongated body configured to be inserted into the neck of the container; a resilient shoulder provided at an upper end of the elongated body, wherein the resilient shoulder is arranged for resting onto an upper side of the neck of the container; a stop ring provided at an upper end of the elongated body above the resilient shoulder; a valve arranged inside of the elongated body for allowing, in use, air to be sucked out of the container; wherein the elongated body further comprises at least one radially protruding flange element.

By providing a vacuum stopper having a resilient shoulder and a stop ring above the resilient shoulder, wherein the valve is arranged inside of the elongated body, a compact and elegant vacuum stopper can be obtained. By providing the stop ring above the resilient shoulder, the vacuum stopper can be of a limited height, such that, when the vacuum stopper is inserted in the neck of the container and the resilient shoulder abuts onto the upper side of the neck of the container, the stopper only limitedly extends above the upper side of the neck of the container. Thus, an elegant and compact view may be provided with the stopper inserted into the container, typically a bottle, such as a wine bottle. Contrary to a conventional stopper, the said stopper is not provided with a head, but only is provided with an elongated body in which elongated body the valve is arranged. By arranging the valve inside of the elongated body, and not, as in a conventional stopper, in the head of the stopper, the head of the stopper can be obviated and thus the height of the stopper can become lower such that it only limitedly extends above the neck of the container when in use.

By providing a resilient shoulder at an upper end of the elongated body, almost all of the elongated body may be inserted into the neck of the container, such that only a limited height of the elongated body extends above the neck of the container. By providing the shoulder, in use resting on the neck of the container, resiliently, the shoulder deforms upon vacuuming of the container and a tight sealing of the shoulder to the neck of the container can be obtained. By sucking air out of the container via the valve arranged inside of the elongated body, an negative pressure, or so-called vacuum, can be created inside of the container. Due to the negative pressure the stopper may be pulled somewhat more inside of the container, resulting in deformation of the resilient shoulder. A deformation of the resilient shoulder may provide for a tight abutting of the shoulder to the neck of the container and for a firm and/or reliable sealing of the container in vacuum. By providing for such a resilient shoulder that deforms when there is vacuum in the container, a visible indication of the vacuum is possible, for example by the deformed resilient member being lower than the undeformed resilient member. The negative pressure is considered to be a pressure below the atmospheric pressure, also called an under pressure or a vacuum.

By providing the stop ring above the resilient shoulder, the stop ring may prevent the resilient shoulder, and, thus, the stopper, from being sucked into the container when vacuuming. Contrary to a conventional stopper there is an additional stop ring provided, as a separate stop ring, or, integrated to the resilient shoulder. The stop ring is more stiff than the resilient shoulder, such that the resilient shoulder, in use, can deform upon vacuuming of container to tightly abut against the upper side of the neck of the container. Also, the stop ring is advantageously above the resilient shoulder, as a final stop element preventing the stopper from fully entering the container.

The stop ring may be positioned approximately level with an upper side of the elongated body, as such a compact stopper can be obtained in which the stop ring is the top member of the stopper, and there is no head extending above the stop ring or the body of the stop ring as in the conventional stoppers. This makes the stopper compact and elegant. Also, by providing the stop ring above the resilient shoulder and at the same level as the upper side of the elongated body, in use, only the shoulder and the stop ring are above the neck of the container. So, when the stopper is inserted in the neck of the container, it only extends above the neck of the container over a limited height, namely the height of the resilient shoulder and the stop ring. Due to this limited height, the container, typically a wine bottle, with the stopper engaged in its neck, can still be stored in normal storage locations such as a refrigerator or a cabinet.

The stop ring and the resilient shoulder may be provided from a different material and/or of a different configuration.

The stop ring may e.g. be of a metallic material or of a relatively stiff plastic material. The stop ring may be configured as a radially extending ring. Advantageously, the stop ring is continuous in circumferential direction, however, the stop ring may also be embodied as at least two ring segments. The stop ring may be firmly connected to the elongated body, e.g. by a click connection or may be integrated to the elongated body, e.g. by means of dual component injection moulding. The resilient shoulder may be of a resilient, elastic material or may have a resilient configuration, or may be a combination of both. For example, an under side of a continuous stop ring may be provided with an elastic material, such as a rubber material or a closed-cell foam, or another elastically deformable material. When the resilient member then abuts against the neck, the material can deform upon vacuuming, and a firm sealing can be obtained. The stop ring, being more stiff, may then obviate that the stopper is pulled into the container. In that example, the stop ring and sealing member may e.g. be simultaneously injection moulded via a two-component injection moulding process. Alternatively, a more elastic material of the resilient shoulder may be glued or otherwise via an adhesive be connected and/or chemically bonded to the stop ring. In order to obtain a tight sealing over the circumference of the neck, the resilient member is of a continuous design in circumferential direction.

The resilient member may also be of a resilient, or elastically deformable, configuration, e.g. a more spring-like configuration may be possible, such as a blade spring-like configuration or a wave spring-like configuration etc. The material is nevertheless a flexible material allowing deformation. Due to the vacuum inside of the container, when the stopper is inserted in the neck of the container, the resilient configuration of the resilient shoulder is deformed until a tight abutting of the resilient shoulder onto the neck of the container is obtained. The resilient shoulder may for example be provided of a thermoplastic composite material, or another material, for example silicon rubber or thermoplastic elastomers (TPE), such as styrenic block copolymers, e.g. SEBS.

The resilient shoulder advantageously is deformable between a rest position in which the resilient shoulder is undeformed, and a use position in which the resilient shoulder is deformed, when the stopper is positioned in a neck of a container and the inside of the container is vacuum. In the deformed position of the resilient shoulder the height of the shoulder may be smaller than the height of the shoulder in the undeformed position and/or the length of the shoulder may be longer than the length of the shoulder in the undeformed position. The resilient shoulder may be adjusted to the deformed position because the shoulder becomes squeezed between the stop ring above it and the neck of the container below it when the inside of the container is being vacuumised.

Alternatively and/or additionally, the resilient shoulder may be configured as a radially extending shoulder that is hingedly connected to the elongated body. The hinge may be a living hinge provided by e.g. a rejuvenation in the material or bend in the material acting as hinge. The resilient shoulder may comprise multiple of such living hinges, e.g. multiple bends in radial direction, that may result in a wave-like pattern in radial direction. Upon vacuuming, with the stopper inserted in the neck of the container, the resilient shoulder may deform at such living hinges or bends, and thus may stretch in radial direction until it firmly abuts against the upper side of the neck of the container. For example, the resilient shoulder can be provided with at least one position around which the resilient shoulder can hinge from the rest position to the working position. Such position may be predefined in a radial direction and preferably extends circumferentially. The position may be predefined, but may also be variable or non-predefined, depending on the flexibility of the material. It may be depending on the positioning of the stopper in the neck of the container how the resilient shoulder may deform upon vacuuming. Many variants of a resilient shoulder are possible.

Advantageously, the resilient shoulder is adjustable between a rest position, to which rest position the resilient shoulder is biased, such that, when the stopper is engaged in the neck of the container, there is no vacuum in the container, and between a working position, in which the resilient shoulder seals the neck of the container, such that, when the stopper is engaged in the neck of the container, there is vacuum in the container. The rest position may typically be a basis position in which the resilient shoulder has its undeformed configuration, as opposed to a deformed position in the working position of the resilient member. In the working position, the resilient member is deformed, and, in practice, it is mounted in the neck of a container with a negative pressure in the container. By biasing the resilient shoulder to its rest position, as soon as the vacuum is undone, the resilient member may return to its predefined rest position to which it is biased. The biasing force may assist in further removing the stopper from the neck of the container as soon as there is a vacuum leakage, either accidentally or on purpose. As such, the resilient shoulder is deformable between the rest position in which the resilient shoulder is undeformed, and a working position in which the resilient shoulder is deformed, when the stopper is positioned in a neck of a container and the inside of the container is vacuum. In the deformed position of the resilient shoulder the height of the shoulder may be smaller than the height of the shoulder in the undeformed position and/or the length of the shoulder may be longer than the length of the shoulder in the undeformed position. For example, the resilient shoulder may be adjusted to the deformed position because the shoulder becomes squeezed between the stop ring above it and the neck of the container below it when the inside of the container is being vacuumised.

When the resilient shoulder is deformed due to the negative pressure in the container, in its working position, the resilient shoulder may be of a lesser height than in undeformed rest position. Due to this difference in height between the undeformed rest position and the deformed working position, the user can visually inspect whether there is vacuum in the container or not. When there is a low height of the resilient member, there is still vacuum in the container, and when the height of the resilient member is larger, the resilient member is in its rest position and there is no vacuum in the container. This gives the user an easy to identify visual indication of the vacuum in the container. As such, the user can check whether there is still vacuum in the container without first undoing the vacuum and then re-vacuuming the container, as is often the case with conventional stopper.

Furthermore, due to the firm and reliable deformation of the resilient member under vacuum of the container, it is possible to store the container in a lying position without, accidentally, undoing the vacuum. This is often difficult with conventional stoppers due to the relatively bulky head protruding from the neck of the container, by which easily accidental undoing of the vacuum is possible. Also, a conventional stopper often seals the neck of the container with its body inserted in the neck of the container, which may leak relatively easily in case of horizontal storage. The stopper having the resilient member sealing the neck on the upper side of the neck of the container may prevent leakage of vacuum and/or liquid when stored in a lying position. Also, due to its compact dimensions, the stopper according to the invention may provide for a more reliable sealing of the neck of the container. Moreover, due to its compact dimensions, the stopper may fit in the neck of the container, in particular a wine bottle, while a screw cap still may fit on the neck of the container and over the stopper. This may provide even for a more reliable storage, in particular horizontal storage.

According to an aspect of the stopper, the elongated body may be provided, at an outer side thereof, with at least one flange element, wherein the at least one flange element can be provided as a circumferential continuous flange. The flange may for example be embodied as a radially outwardly protruding ring on the elongated body. The flange element helps in aligning and/or centering of the elongated body into the neck of the container such that the elongated body is positioned approximately centrally in the neck of the container. Also, variations in inner diameter of the neck of the container may be accommodated by providing the at least one flange element. More than one circumferential flange positioned one above the other may be provided. The flange element preferably protrudes radially outwardly from an outer side of the elongated body, such that the flange element, in use, can contact an inside of the neck of the container.

Alternatively, multiple flange elements extending in circumferential direction at the same axial position of the elongated body, or extending in longitudinal direction may be provided. The flange elements may be somewhat flexible such that they allow maneuvering of the elongated body in the neck of the container.

The elongated body may be cylindrically shaped, having e.g. an annular cross-section, or may have a triangular or hexagonal cross-section. Many variants are possible. By providing at least one flange element on the elongated body, centering and/or contact to an inside of the neck of the container may be provided, as well as variations in inner diameter of the neck of the container may be accommodated.

The elongated body may be somewhat deformable under influence of vacuum as well. When inserted into the neck of the container and sucking air out of the container via the valve in the elongated body, due to the negative pressure obtained in the container, the elongated body may be deformed as well. Due such a deformation, the outer diameter of the elongated body may enlarge somewhat, thus pressing the at least one flange element more to the inner side of the neck of the container. This may improve the alignment and securing of the stopper in the neck of the container. Advantageously, the stop ring is more stiff than the elongated body and the elongated body is more stiff than the resilient shoulder, such that the sealing is obtained at the resilient shoulder, and the stop ring can prevent sucking in of the stopper into the container when vacuuming.

Advantageously, the valve is entirely positioned inside of the elongated body, such that an upper side of the valve is lower than an upper side of the elongated body, such that the stop ring can form the upper side of the stopper. Thus having a rather compact stopper. The valve may for example be positioned approximately half way inside of the elongated body.

The upper side of the elongated body and/or of the stop ring are configured to receive a vacuum pump. The vacuum pump can be a known manual pump. The upper side of the stopper may be relatively flat as to engage with various types of vacuum pumps. Alternatively, a vacuum pump may engage around the valve inside of the elongated body. The stopper is configured such that there are many possibilities for engaging with a vacuum pump to suck air out of the container via the valve. The valve may be a one-way valve such that air can be guided in one direction only, namely out of the container, and when the valve is closed, air is blocked from entering via the valve into the container. A typical example of such a one-way valve is a duck bill valve, but other variants of valves may be possible as well.

In an example of the stopper, the outer diameter of the stop ring is approximately 1.5 times the outer diameter of the elongated body, including the at least one flange element in a non-vacuumed rest position of the stopper. By having the stop ring a relatively limited size with respect to the rest of the stopper, it may be sufficient to abut on the upper side of the neck of the container without overhanging the neck of the container too much. Thus, the stopper, in particular the stop ring and resilient member, when inserted into the neck of the container, may be sufficiently wide to seal onto the neck of the container, but may be sufficiently small as not to extend too much over the neck of the container. As such, it is possible that a screw cap may fit over the neck of the container with the stopper inserted therein. This may be advantageous for storage purposes of the container.

A further aspect relates to an assembly of a container and a vacuum bottle.

Further advantageous embodiments are represented in the subclaims.

Figure 1B:
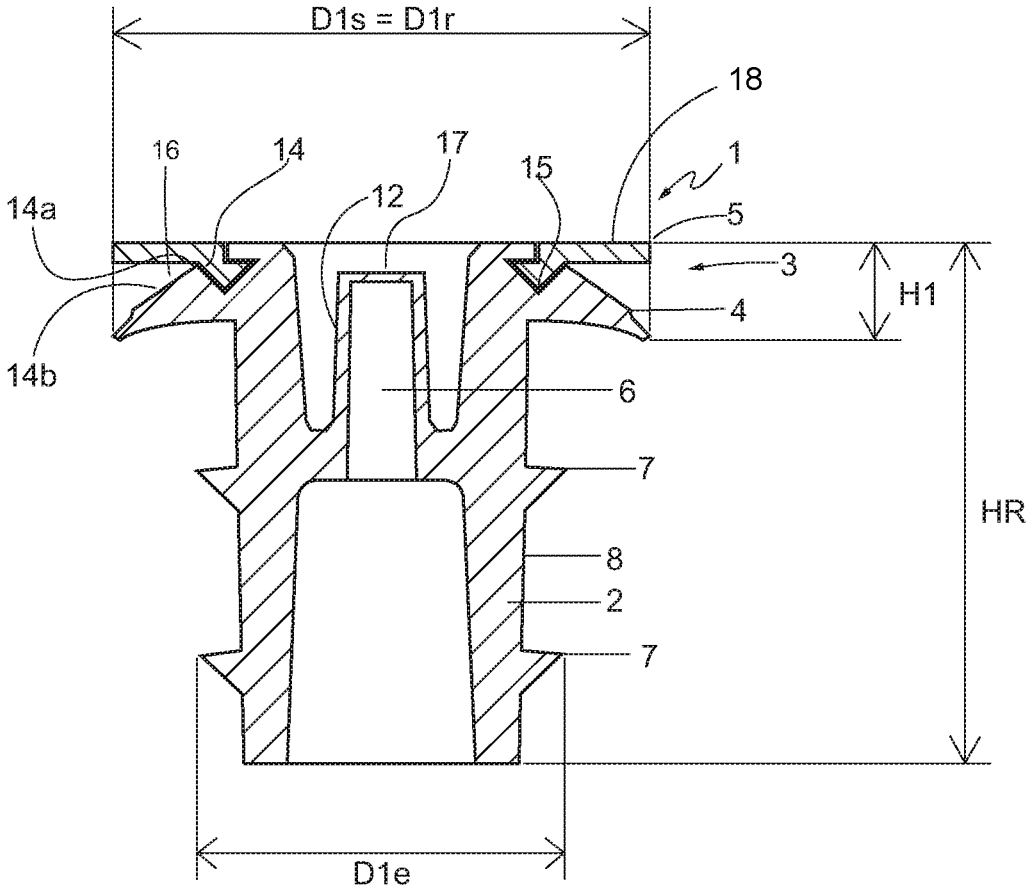

These and other aspects will be further elucidated with reference to the drawing comprising figures of exemplary embodiments. Corresponding elements are designated with corresponding reference signs. In the drawing shows:

FIG. 1*a* a schematic perspective view of a first embodiment of the stopper;

FIG. 1*b* a cross-section of the stopper of FIG. 1*a;*

Figure 2A:
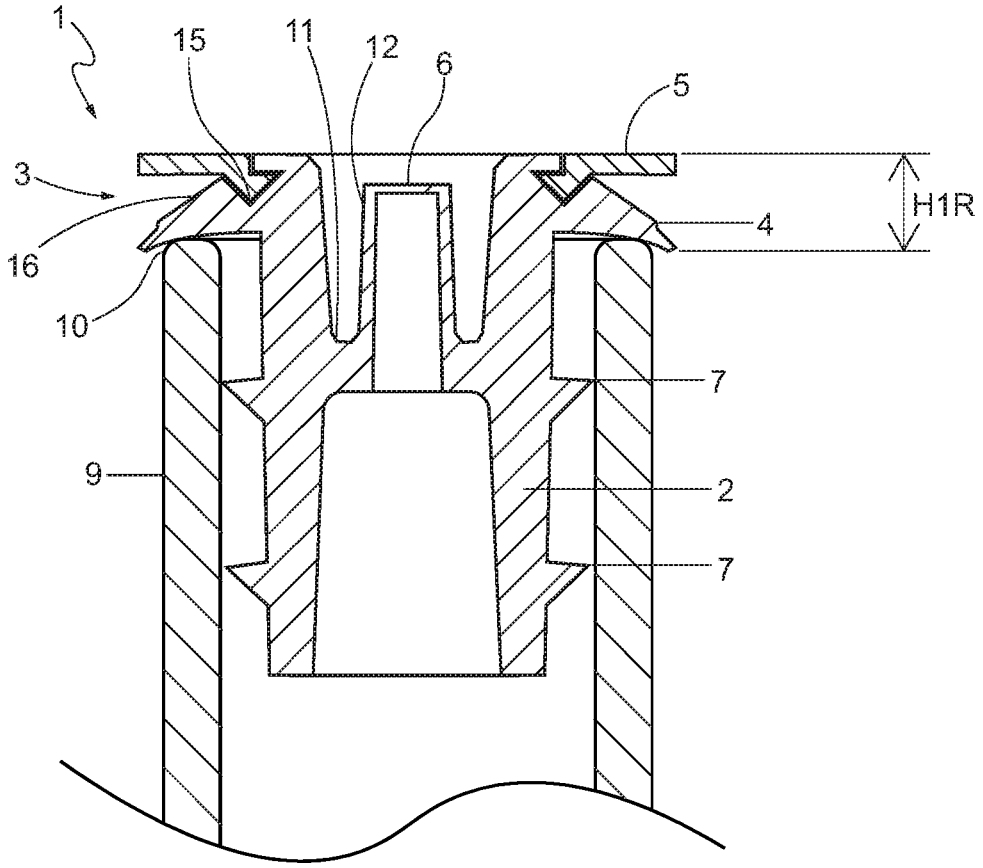
Figure 2B:
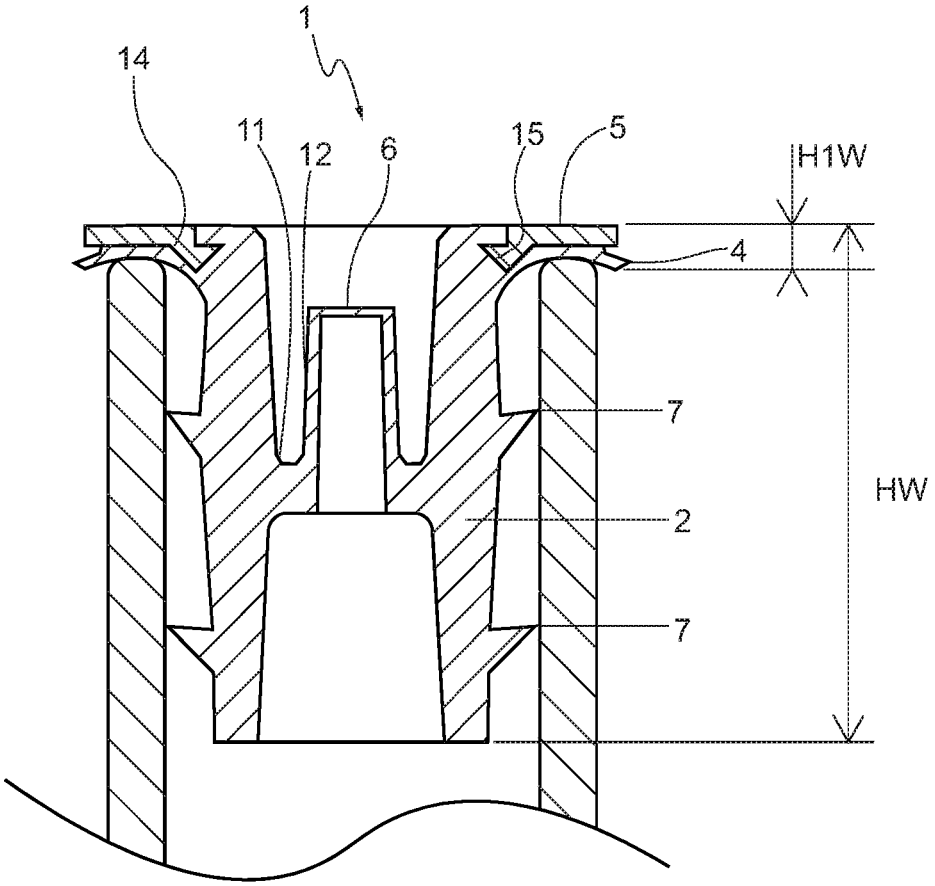
Figure 3A:
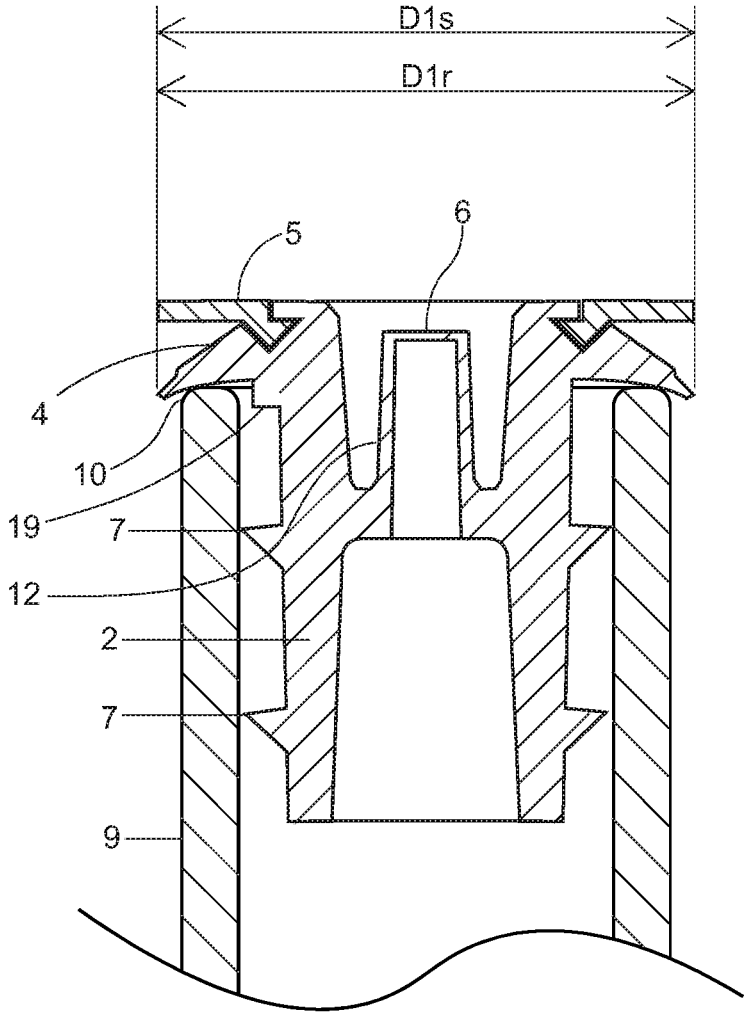
Figure 3B:
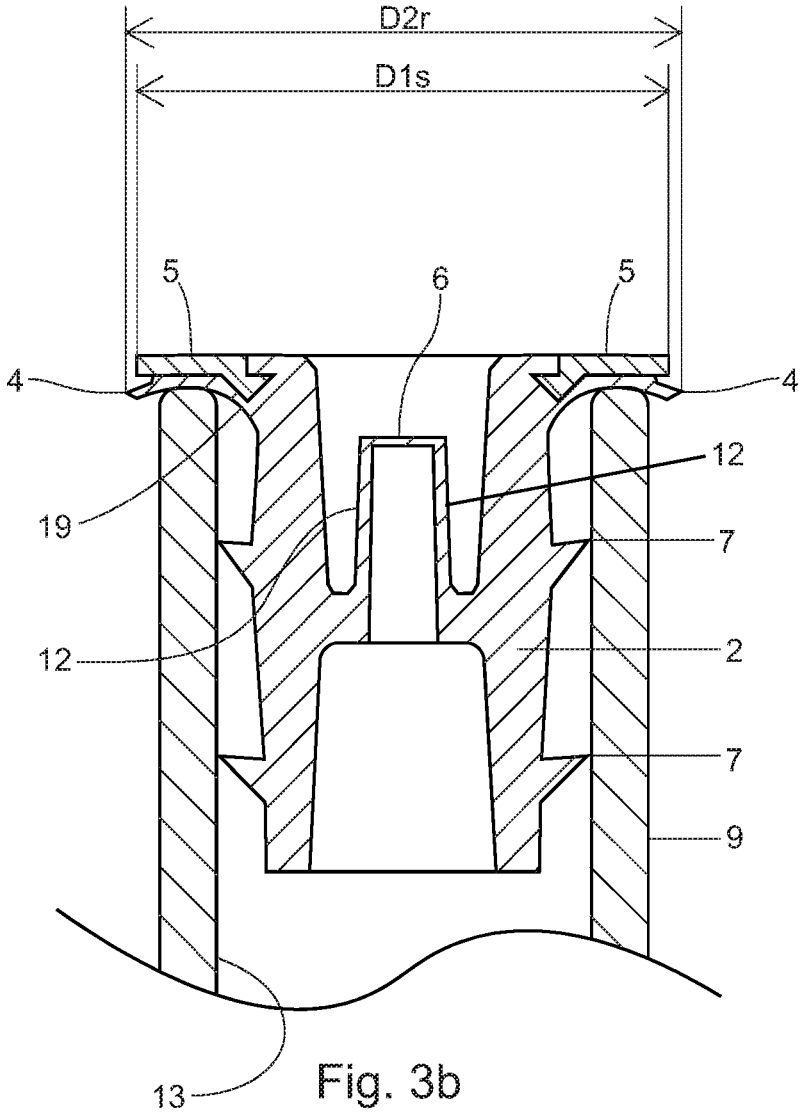
Figure 4:
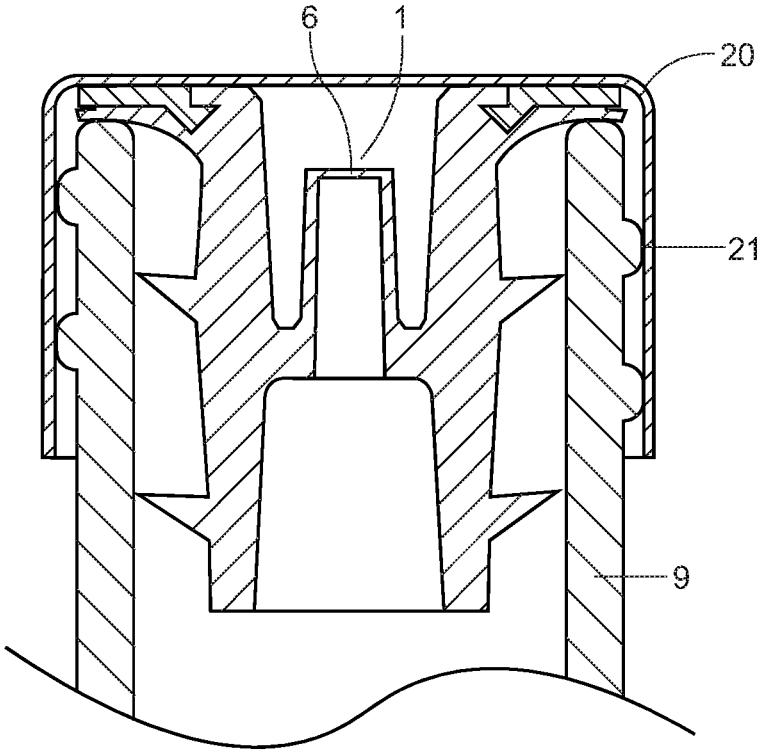
Figure 5A:
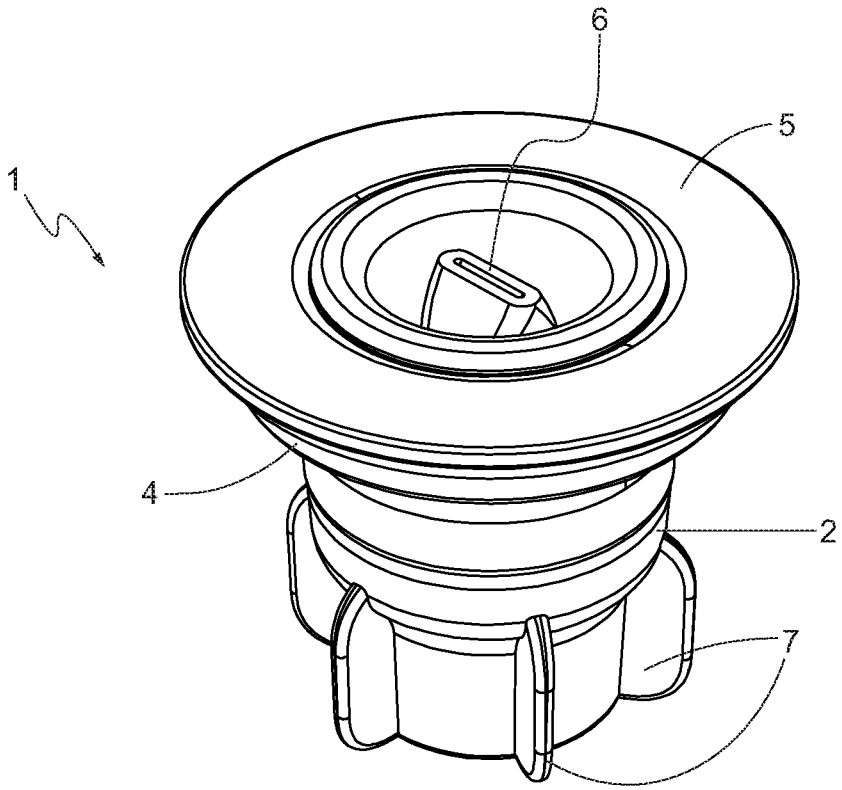
Figure 5B:
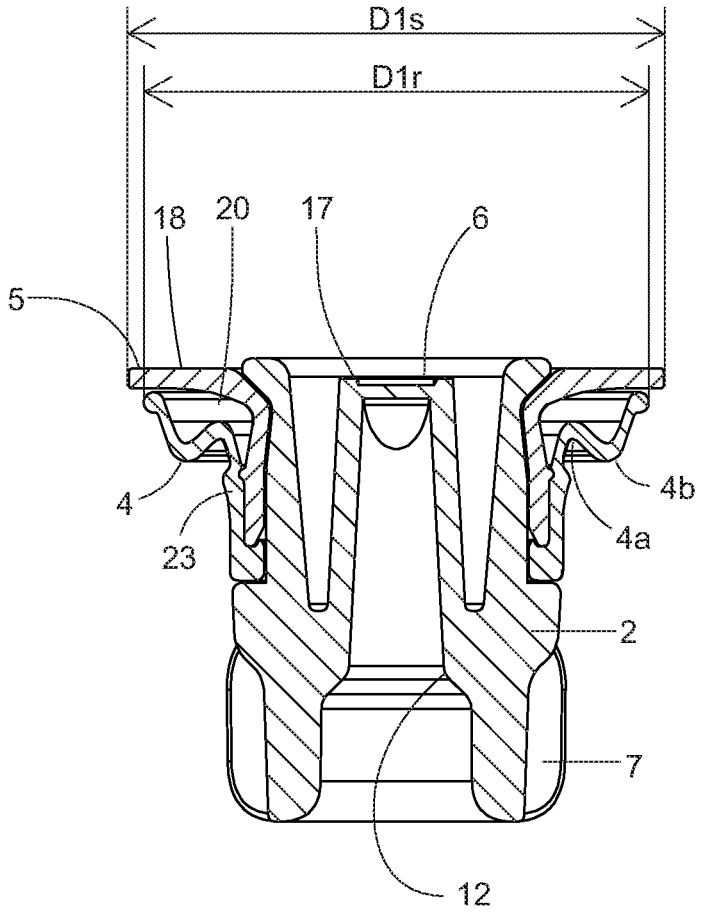

FIG. 2*a* a schematic cross-sectional view of the stopper of FIG. 1*a* in a rest position in the neck of a container;

FIG. 2*b* a schematic cross-sectional view of the stopper of FIG. 1*a* in a working position in the neck of a container;

FIG. 3*a* a schematic cross-sectional view of a second embodiment of a stopper in a rest position in the neck of a container;

FIG. 3*b* a schematic cross-sectional view of the stopper of FIG. 3*a* in a working position in the neck of a container;

FIG. 4 a schematic cross-sectional view of a stopper inserted into the neck of the container closed by a screw cap;

FIG. 5*a* a schematic perspective view of a third embodiment of the stopper;

FIG. 5*b* a cross-section of the stopper of FIG. 5*a;*

Figure 5C:
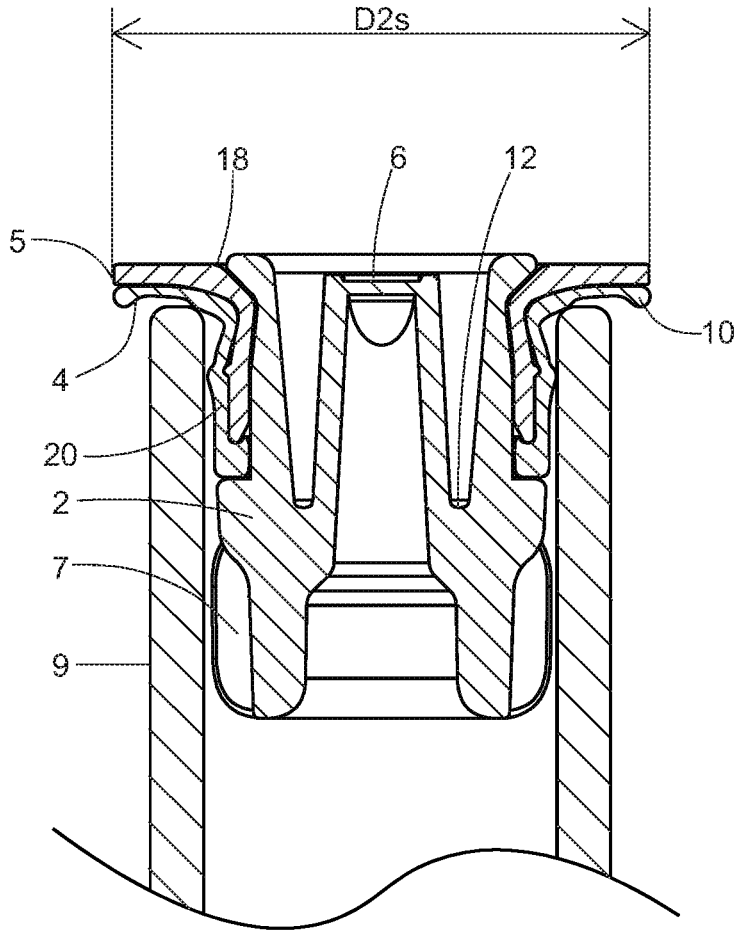
Figure 6A:
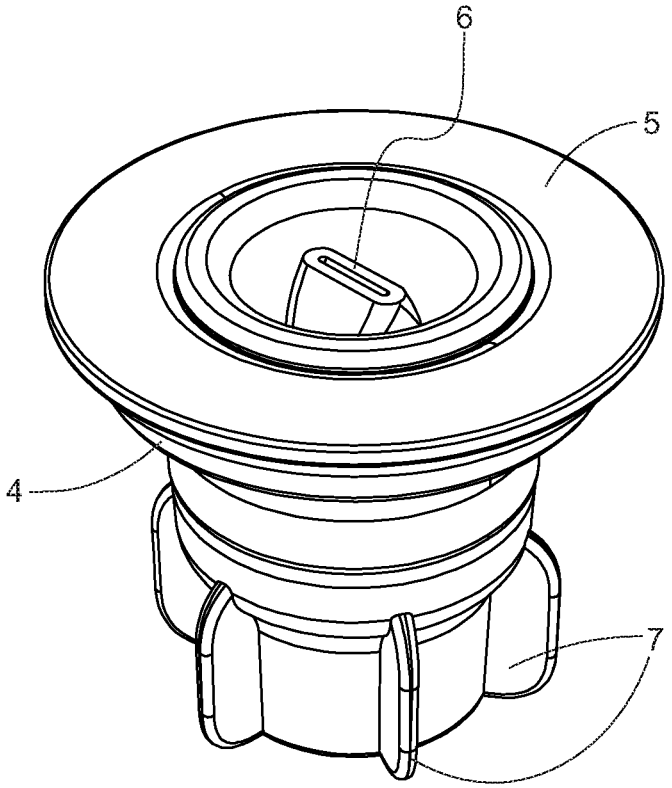
Figure 6B:
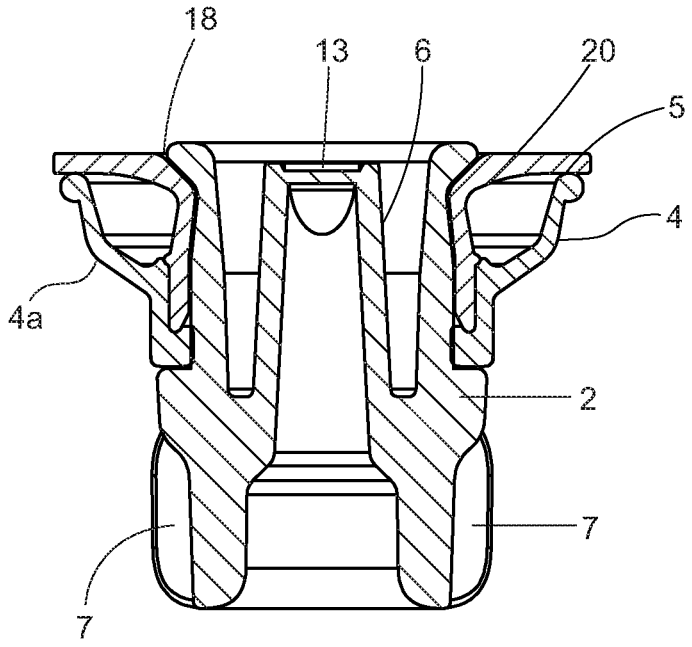

FIG. 5*c* a schematic cross-sectional view of the stopper of FIG. 5*a* in a working position in the neck of a container;

FIG. 6*a* a schematic perspective view of a third embodiment of the stopper;

FIG. 6*b* a cross-section of the stopper of FIG. 6*a;*

Figure 7A:
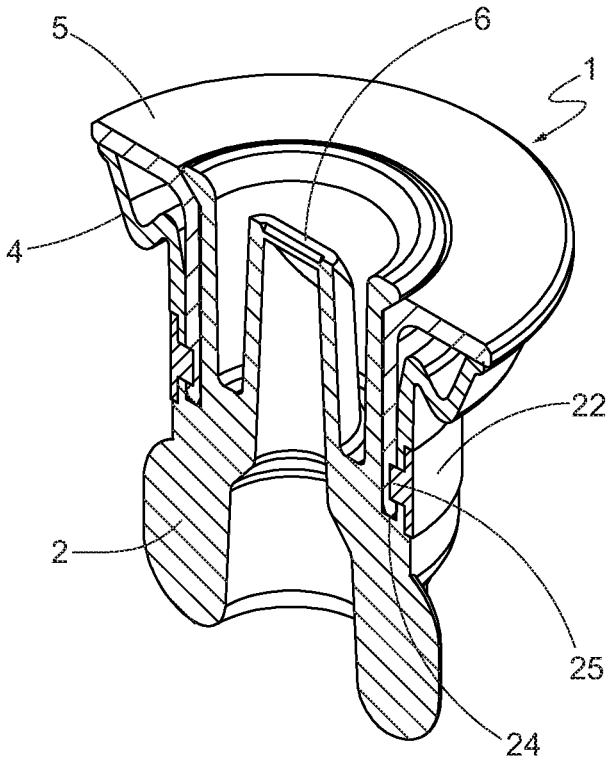
Figure 7B:
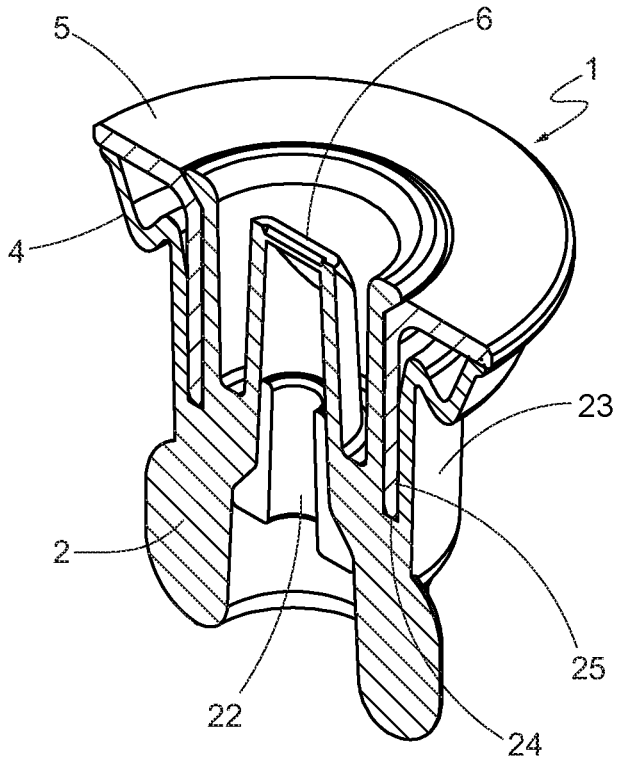
Figure 8A:
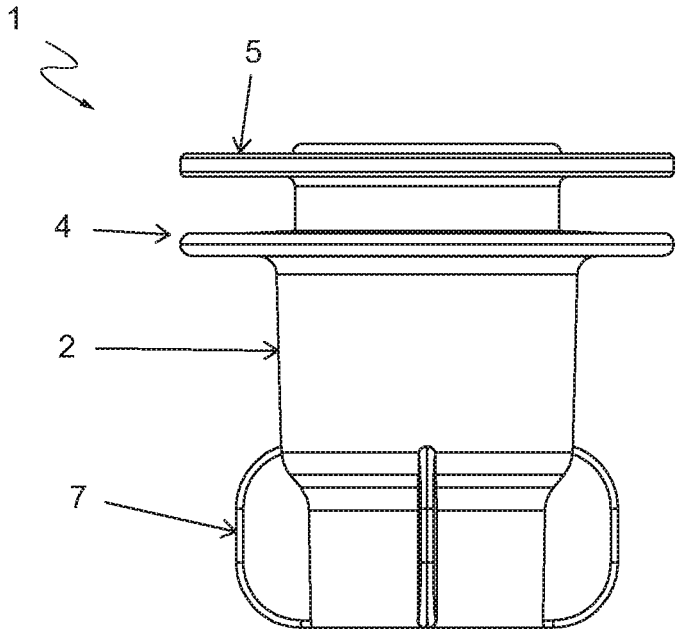
Figure 8B:
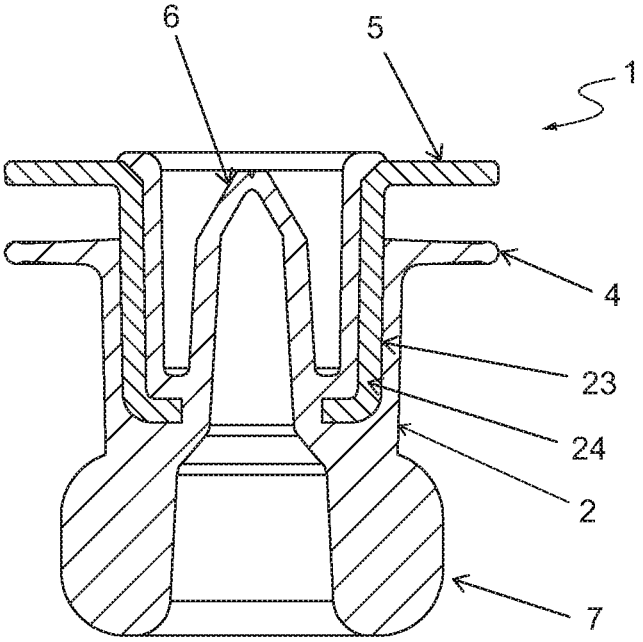

FIG. 7*a* a perspective cross-section of an alternative embodiment of the stopper;

FIG. 7*b* a perspective cross-section of an alternative embodiment of the stopper;

FIG. 8*a* a front view of an alternative embodiment of the stopper;

FIG. 8*b* a cross-sectional view of the embodiment of FIG. 8*a.*

It is to be noted that the figures are given by way of exemplary examples and are not limiting to the disclosure. The drawings may not be to scale.

FIG. 1*a* schematically gives a perspective view of an embodiment of a vacuum stopper 1, FIG. 1*b* shows a cross-section of the stopper 1 of FIG. 1*a*. The vacuum stopper 1 comprises an elongated body 2 that is configured to be inserted into a neck of a container. At an upper end 3 of the elongated body 2, a resilient shoulder 4 is provided. The resilient shoulder 4 is arranged to rest or abut onto an upper side of the neck of the container. Further, the vacuum stopper 1 comprises a stop ring 5 at the upper end 3 of the elongated body 2, and the stop ring 5 is arranged above the resilient shoulder 4. A valve 6 is arranged inside of the elongated body 2 to allow air to be sucked out of the container, when the stopper is engaged to the neck of the container. The valve 6 is connected with a valve seat 12 to the elongated body 2. The elongated body 2 is further provided with at least one flange element 7 radially protruding from an outside 8 of the elongated body 2.

The elongated body 2 is here shown as a cylindrically shaped body with an approximately annular or circular cross-section, but can have different shapes as well, e.g. a prism having a polygonal cross-section. Advantageously, the elongated body 2 may have be approximately straight, but a tapered, pyramidal or otherwise shape can be possible, as long as the outer diameter of the elongated body is not large enough for abutting the inner side of the neck of the container to obviate that the elongated body is sealing the container instead of the resilient shoulder.

In this embodiment, the flange element 7 is provided as a continuous ring arranged around the elongated body 2. There are two rings 7 arranged above each other. The flange element 7 is intended to center and/or guide the stopper 1, in particular the elongated body 2, in the neck of the container. The flange element 7 is also somewhat flexible or resilient to accommodate variations in inner diameter of the neck of the container. So, a relatively wide variety of inner diameters of the neck of the container can be accommodated, from relatively small diameters to larger diameters. For a glass wine bottle, such diameter variation of the neck can be between about 20 to about 35 mm. Also, the diameter of the inner bore of the neck can vary as well, since the inner bore of the neck may have an irregular surface. Such variations can be accommodated as well. When the flange element is provided as a continuous ring, there may be at least one cutout be provided in the outer edge of the ring. By providing such a cutout, it can be prevented that the ring-shaped flange element seals the neck of the container to a vacuum. Instead, the resilient shoulder is configured to seal the neck of the container when vacuuming the container.

In FIG. 2*a*, the stopper 1 is shown as inserted into the neck 9 of a container (not shown). The container can be e.g. a bottle, such as a wine bottle, or a flask etc. In FIG. 2*a* it can be seen that the flange elements 7 are somewhat deformed upwardly due to the friction forces during the insertion of the elongated body 2 in the neck 9 of the container. As such, a more or less central positioning of the elongated body 2 in the neck 9 of the container can be possible.

The resilient shoulder 4 is arranged to sit onto an upper side 10 of the neck 9 of the container. The resilient shoulder 4 extends radially outwardly from the elongated body 2 of the stopper 1. The resilient shoulder 4 can be integrally formed with the elongated body 2, as can be seen here, but can also be a separate part that is connected to the elongated body 2.

FIG. 2*a* shows the stopper 1 in a rest position, in which it is inserted into the neck 9 of the container, but there is no vacuum. The resilient shoulder 4 is in a rest position as well, in that it sits onto the neck 9 of the container. Upon vacuuming of the container, air is sucked out of the container via the valve 6. The stopper 1, in particular the elongated body 2 is thus being pulled further into the neck of the container. Due to this downward movement, the resilient shoulder is being pressed more against the upper side 10 of the neck of the container such that the resilient shoulder 4 deforms. Due to this deformation, the resilient shoulder 4 sealingly engages with the neck of the container, in particular with the upper side 10 of the neck of the container such that a vacuum can be created and maintained. The resilient shoulder 4 is thus deformed to a working position as can be seen in FIG. 2*b*. For undoing the vacuum inside of the container, it suffices to lift or tilt the stop ring 5 upwardly such that it pulls the resilient shoulder 4 upwardly as well and the sealing engagement can be undone. The stopper 1 can then be removed from the neck of the container by pulling at the stop ring 5. Due to the firm sealing engagement of the resilient shoulder 4 with the neck of the container, accidentally undoing the vacuum in the container by contacting the stop ring can be minimized. The stop ring 5 is to be pushed upwardly for removing the vacuum.

Advantageously, the elongated body 2 is made of a flexible and/or deformable and/or resilient and/or elastic material. These terms can be used interchangeable throughout this disclosure, in the meaning that the shape of the elongated body can change, e.g. due to the negative pressure, or due to the insertion in the neck of the container, when stopper is taken out of the neck of the container it can take its original, undeformed shape again. Due to the vacuum inside of the container, the valve 6 may be pulled further downward as well, since the valve seat 12 is relatively thin and thus flexible, allowing downward movement of the valve 6 with respect to the connection 11 of the valve seat 12 on the elongated body 2. Due to this downward movement of the valve 6, it pushes the elongated body 2 more outwardly at the position 11 of its connection to the elongated body 2. Due to this slightly outward movement, the flange element 7 arranged on the outside 8 of the elongated body 2 is also pushed more firmly against the inner wall 13 of the neck 9, thus providing for a more firm engagement of the stopper 1 in the neck 9 of the container. Also, due to the negative pressure inside of the container, the valve 6 may move somewhat more downwardly in the direction of the interior of the container. This can be seen in FIG. 2*b*, although schematically and in exaggeration.

The stop ring 5 that is arranged above the resilient shoulder 4 is firmly connected to the elongated body 2. The stop ring 5 is advantageously more stiff than the resilient shoulder 4 and can, as such, prevent the stopper 1 from being sucked into the container when vacuuming the container. The stop ring 5 can be of a different material than the resilient shoulder 4 and/or the elongated body 2, but may also be of the same material, but of a more stiff construction. The stop ring 5 may be integrated to the elongated body 2, but may also be a separate component that is firmly connected or fixated to the elongated body 2. For example via a tooth-in-groove connection 14 as in the embodiment shown in FIG. 1*b*. Here, the stop ring 5 is provided with a circumferentially extending toothed protrusion 14*a* that fits into a circumferential groove 14*b* of the resilient shoulder 4. The stop ring 5 is here also provided as a continuous circumferential ring, but it can be configured as one, two or more ring segments as well. The stop ring 5 may also have another shape than the ring as shown in FIG. 1*a*, but may be rectangular, or triangular or any other shape. Many variants are possible.

The resilient shoulder 4 is in this example hingedly connected to the elongated body 2 via a living hinge 15. The resilient shoulder 4 can rotate around the hinge 15 between the rest position, as shown in FIG. 2*a*, and the working position, as shown in FIG. 2*b*, allowing the elongated body 2 to move downwardly in the neck 9 of the container. Additionally, the resilient shoulder 4 is made of an elastically deformable material allowing the resilient shoulder 4 to be compressed between the upper side 10 of the neck 9 of the container and the stop ring 5. Due to this compression of the resilient shoulder 4, the resilient shoulder 4 extends more radially outwardly such that a larger engagement area with the upper side 10 of the neck 9 of the container may be obtained. Such a relatively large engagement, may allow for a firm sealing of the resilient shoulder 4 with the neck 9 of the container. The sealing engagement between the resilient shoulder 4 and the upper side 10 of the neck 9 of the container, and not, as in the prior art between the elongated body and the inside of the neck of the container, allows the container to be stored in lying position, also when vacuumed, without the risk on leakage or, accidentally undoing of the vacuum.

In the example of FIG. 1*a*-FIG. 2*b* the resilient shoulder 4 is tooth-shaped, wherein the tooth 16 is more radially outwardly than the groove 14*b*, the tooth 16 is via the living hinge 15 connected to the elongated body 2. When the stopper 1 is inserted in the neck 9 of the container, and the container is vacuumed, the material of the tooth 16 of the resilient shoulder 4 is being compressed, resulting in elongation of the resilient shoulder 4. Due to the compression and elastic deformation of the resilient shoulder 4, there is difference in height between the rest position and the working position. In rest position, the height H1R of the undeformed resilient shoulder 4 and the stop ring 5 extending above the upper side 10 of the neck of the container is larger than the height H1W in the working position, when the resilient shoulder 4 is compressed and elastically deformed. Thus, the user has a visual indication when there is vacuum in the container, namely when the height of the resilient shoulder 4 with the stop ring 5 is smaller than in rest position. In an example, the height H1W may be between about 0.5 mm to about 5 mm or between about 1 mm to about 4 mm.

The resilient shoulder 4 is biased towards its undeformed rest position, such that, when releasing the vacuum in the container, e.g. by tilting the stop ring 5, the resilient shoulder 4 moves back to its undeformed position, and, as such, the biasing force may aid to undo the vacuum once a user has created an opening in the sealing engagement. The pressure force on the resilient shoulder acted upon by vacuuming of the container, is then larger than the biasing force to firmly press the resilient shoulder 4 against the upper side 10 of the neck 9 of the container. So, the vacuum in the container needs to be sufficient to overcome the biasing force of the resilient shoulder 4, thus providing for a firm sealing engagement that cannot easily be undone by accidental contact, but mainly by a deliberate action of a user.

In rest position of the stopper 1, the stopper 1 has a height HR. When the stopper 1 is mounted in the neck of the container, and air is sucked out of the container such that a negative pressure is obtained in the container, the stopper 1 is pulled into the container under influence of the negative pressure. The elongated body 2, made from resilient material, becomes larger, and the shoulder 4 is being pressed onto the neck of the container by the stop ring 5. The height of the stopper 1 in this working position then becomes a height HW that is larger than the height HR in rest position. This can be seen in FIG. 2*a* and FIG. 2*b*, although in these figures differences in height H1R–H1W and HR–HW are presented in exaggeration and not to scale.

A vacuum pump may be positioned on the upper side 18 of the stopper 1, or may engage with the seat 12 of the valve 6 or at any position therebetween. There are many possibilities for engagement with a vacuum pump.

As can be seen in FIGS. 1*a*-2*b*, the valve 6 is entirely mounted inside of the elongated body 2. The valve 6 is preferably a one-way valve, for example a duck bill valve, but other embodiments of the valve 6 are also possible. By mounting the valve 6 inside of the elongated body 2 such that an upper side 17 of the valve 6 is lower than the stop ring 5, the stopper 1 can be of a compact design. The stop ring 5 forms then the upper side 18 of the stopper 1, and a bulky head, as in the conventional stopper can be obviated. As such, only the resilient shoulder 4 and the stop ring 5 are above the upper side 10 when the stopper 1 is inserted in the neck 9 of the container. The height thereof, height H1R in undeformed rest position, is relatively small compared to the total height HR of the stopper 1 in undeformed position. So, when the stopper 1 is inserted in the neck 9 of the container, this gives an elegant and smooth appearance without disturbing the general visual appearance of the container. This is felt as an advantage by the users. Moreover, due to the compact size of the stopper 1, and the limited height of the stopper 1 above the neck of the container, the container with the stopper can be stored in known storage facilities, such as a refrigerator or a cabinet, without a bulky head as with the conventional stopper abutting against the storage facility.

FIG. 3*a* and FIG. 3*b* show an alternative embodiment that additionally to the embodiment of FIGS. 1*a*-2*b* is provided with an abutment element 19. The abutment element 19, in addition to the stop ring 5, prevents that the stopper 1 is sucked into the neck 9 of the container. Due to the compression of the resilient shoulder 4, and the elongated body 2 moving downwardly in the neck 9 of the container, the abutment element 19 abuts against the inner wall 13 of the neck 9 of the container, thus further fixating the stopper 1 in the neck 9 of the container. FIG. 3*a* shows the stopper 1 with the abutment element 19 in the undeformed rest position, and FIG. 3*b* shows the stopper 1 with the abutment element 19 in the deformed working position.

Advantageously, the outer diameter D1*s* of the stop ring 5 is approximately the same as the outer diameter D1*r* of the resilient shoulder 4 in undeformed condition. In the examples of FIGS. 1*a*-3*b*, the outer diameters D1*s* and D1*r* are the same. In deformed position of the resilient shoulder 4, the outer diameter D2*r* may be somewhat larger than the outer diameter D1*s* of the stop ring 5 due to the deformation of the resilient shoulder 5 in the working position. The difference between the outer diameter D2*r* and D1*r* can be relatively small, e.g. about 1 mm to about 3 mm. Advantageously, the outer diameter D1*r*, D2*r* is sufficiently large to accommodate a usual variation in diameter of the neck 9 of the container, but is not too large to extend too much over the neck of the container. For example, the outer diameter D1*r*, D2*r* is approximately 1.5 times the outer diameter D1*e* of the elongated body 2 including the flange elements 7 in undeformed condition. By not having the resilient shoulder 4 and the stop ring 5 extending too much outwardly, it is possible that the stopper 1, when engaged in the neck 9 of the container, can be covered by a screw cap 20 engaged to the neck 9, provided with screw thread 21, as shown in FIG. 4. This allows for a more convenient and elegant storing of the container, even in lying position.

FIG. 5*a*, FIG. 5*b* and FIG. 5*c* show an alternative embodiment of the stopper 1. In this embodiment, multiple flange elements 7 are provided arranged around the circumference of the elongated body 2. The flange elements 7 extend in longitudinal direction along the outer side of the elongated body 2. Here too, the valve 6, embodied as a duck bill valve, is mounted entirely within the elongated body 2, such that the upper side 17 of the valve 6 is approximately level with or lower than the upper side 18 of the stop ring 5.

Here, the stop ring 5 and the resilient shoulder 4 are provided as separate parts that are engaged to the elongated body 2, preferably fixated to the elongated body 2, for example via a chemical bonding connection, an adhesive connection, or a mechanical click connection etc. Here, in the embodiments of FIGS. 5 and 6, a mechanical connection is provided.

In undeformed rest position of the resilient shoulder 4, as shown in FIG. 5*a* and FIG. 5*b*, the resilient shoulder 4 is provided with a wave-like or spring-like cross-sectional shape. Due to this shape and the flexibility of the material, deformation of the resilient shoulder 4 under influence of the vacuum pulling the stopper 1 downwardly can become relatively easy. The resilient shoulder 4 can thus deform to a working position as shown in FIG. 5*c*. The resilient shoulder 4 has here two predefined bends in the shoulder 4*a*, 4*b* that are straightened negative pressure to the position shown in FIG. 5*c*. The resilient shoulder 4 is also biased to the undeformed rest position of FIG. 5*b*, such that, when some pressure is released upon undoing of the vacuum, the resilient shoulder 4 intends to return to its undeformed rest position. The bends 4*a*, 4*b* can be formed as living hinges or may be formed as rejuvenations in wall thickness of the resilient shoulder, or may be formed by a locally larger flexibility of the material etc. By providing such a double wave-like shape, as shown in FIG. 2*a*, upon deformation, the resilient shoulder 4 may deform until it abuts against the stop ring 5, in particular until a corner 20 of the stop ring 5. As such, a firm and tight sealing of the resilient shoulder 4 on the upper side 10 of the neck 9 can be obtained. In FIG. 5*c*, the stopper 1 is shown in deformed position, inserted in the neck 9 of the container and under vacuum. The resilient shoulder 4 is in working position, deformed between the stop ring 5 and the upper side 10 of the neck 9 of the container. The flange elements 7 contact the inner wall 13 of the neck 9 of the container. Here, the valve 6 is entirely inside of the elongated body 2, connected to the inner wall 13 of the elongated body 2 with the seat 12. Here, the seat 12 is more stiff than in the embodiments of FIGS. 1*a*-4, so the valve 6 is barely pulled downwardly by the vacuum in the container, but the flange elements 7 provide for a centering and/or alignment of the elongated body 2 in the neck 9 of the container. The outer diameter D1*s* of the stop ring 5 is slightly larger than the outer diameter D1*r* of the resilient shoulder 4, such that, when deformed the outer diameter D2*r* of the resilient shoulder is approximately the same as the outer diameter D1*s*. As such, the stop ring 5 and the resilient shoulder 4 do not extend too much out of the neck of the container and may fit e.g. under a screw cap. The stop ring 5 forms the upper side 18 of the stopper 1 and is approximately level with the upper side of the elongated body 2. So, the stop ring 5 and the resilient shoulder 4 have a limited height with respect to the elongated body 2 and only extend over a few millimeters above the neck of the container. So, a compact and/or elegant stopper can be obtained. In this embodiment of the stopper 1, a vacuum pump can engage with the upper side 18 of the stopper 1 or with the valve seat 12 or at any position therebetween.

FIG. 6*a* and FIG. 6*b* show an alternative embodiment to the example of FIGS. 5*a*-5*c*. Here, the resilient shoulder 4 is in its undeformed position shaped as spring with a single bend 4*a*. By providing this shape, upon deformation, the resilient shoulder 4 is pushed firmly in the corner 20 of the stop ring 5 and against the stop ring 5 to sealingly engage with the upper side of the neck of the container.

FIG. 7*a* and FIG. 7*b* show alternative embodiments of the stopper 1 in which a retaining member 22 is used. The retaining member 22 is arranged for retaining the rigid stop ring 5 to the resilient or flexible elongated body 2 and flange 4. Due to the differences in resiliency of the stop ring 5 and the remainder of the stopper 1, both components need to be firmly secured to one another to prevent that the stop ring 5 may become loose from the stopper 1 under influence of a negative pressure. Thereto, a retaining member 22 is provided that firmly secures the stop ring 5 to the elongated body 2 and/or the shoulder 4. In the embodiments of FIG. 7*a* and FIG. 7*b*, the elongated body 2, the shoulder 4 and the valve 6 are made as a single piece component, but, as explained above, a multi-component stopper is also possible. The stop ring 5 is can be a rigid component having a body 23 extending downwardly into a receiving space 24 of the elongated body 2, here the receiving space 24 is formed between the elongated body 2 and the flange 4. A similar configuration of the stop ring 5 is provided in the embodiment of FIGS. 5*a*-6*b*. In the embodiment of FIG. 7*a*, the retaining member 22 is provided as a ring 22 fitting around the elongated body 2. At an under side of the body 23 of the stop ring 5 a groove 24 is provided. The ring 22 is provided with a protrusion 25 that fits in the groove 24. Upon mounting of the ring 22 onto the elongated body 22, the protrusion 24 fits in the groove 24 to firmly secure the stop ring 5 to the elongated body 2, and thus to obviate loosening of the stop ring 5 from the stopper 1. The ring 22 can be made from a resilient material, or can be a metal spring etc. Many variants of the ring may be possible. It is noted that the elongated body 2 is flexible, and thus it is possible to mount a rigid ring around the elongated body 2. In the embodiment of FIG. 7*b*, the retaining member 22 is provided as a rigid bush 22 that is being inserted in the elongated body 2. In the embodiment of FIG. 7*b*, the bush 22 is also partly inserted inside of the valve 6, but this is optional. The bush 22 is inserted inside the elongated body 2 sufficiently far such that is presses the elongated body 2 outwardly against the stop ring 5, in particular against the body 23 of the stop ring 5. As such, the retaining bush 22 mechanically locks the body 23 of the stop ring 5 into the receiving space 24 of the elongated body 2, and provides for a secure fixation of the stop ring 5 to the stopper 1. The bush 22 therefore, advantageously, has an outer diameter that is somewhat larger than an inner diameter of the elongated body 2, such that the bush 22 can exert a pressure force outwardly. Also, other embodiments of a retaining member may be considered. For example, it is possible to provide an under side of the body 23 of the stop ring 5 with a hook shaped element, as e.g. shown in FIG. 8, or with a protrusion that mechanically locks into the elongated body, e.g. in openings or apertures or recesses of the elongated body. It may also be considered that such a protruding element of the stop ring 5 engages the resilient material of the elongated body 2 without any predefined openings or recesses. It may be considered that the stop ring 5 of the embodiments of FIG. 1*a*-2*b* may be secured in a same or similar way as described above. The stop ring 5 may e.g. be provided with a protruding element such as a hook that provides for clamping or otherwise engagement to the elongated body.

Alternatively, a chemical securing may be provided between the stop ring 5 and the resilient elongated body. Many variants are possible.

FIG. 8*a* and FIG. 8*b* show a further embodiment of a vacuum stopper 1 having an elongated body 2 that is configured to be inserted into the neck of the container. At an upper end of the elongated body 2 a resilient shoulder 4 is provided, that extends here as a flange radially outwardly from the elongated body 2. The resilient shoulder is arranged for resting onto an upper side of the neck of the container. Further, the stop ring 5 is provided at an upper end of the elongated body 2 and above the resilient shoulder 4. Here, the stop ring 5 has a body 23 that extends axially downwardly into the receiving space 24 between the elongated body 2 and the resilient shoulder 4. Here, the stop ring 5 has at an underside of its body 23 a hook shaped element that engages to the elongated body 2, for example for mechanical connection. A chemical bonding can additionally or alternatively be used as well. The stopper 1 further comprises a valve 6 arranged inside of the elongated body 2 for allowing, in use, air to be sucked out of the container. At an outer side of the elongated body, at least one radially protruding flange element 7 is provided.

There is disclosed a vacuum stopper configured to be positioned into a neck of a bottle for closing the bottle and allowing the bottle to be vacuumised, the vacuum stopper comprising: an elongated body configured to be inserted into the neck of the bottle; a resilient shoulder provided at an upper end of the elongated body, wherein the resilient shoulder is arranged for resting onto an upper side of the neck of the bottle; a stop ring provided at an upper end of the elongated body above the resilient shoulder; a valve arranged inside of the elongated body for allowing, in use, air to be sucked out of the container.

For the purpose of clarity and a concise description, features are described herein as part of the same or separate embodiments, however, it will be appreciated that the scope of the claims and disclosure may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope defined in the following claims.

The invention claimed is:

1. A vacuum stopper configured to be positioned into a neck of a container for closing the container and allowing the container to be vacuumised, the vacuum stopper comprising:

an elongated body configured to be inserted into the neck of the container;

a resilient shoulder provided at an upper end of the elongated body, wherein the resilient shoulder is arranged for resting onto an upper side of the neck of the container;

a stop ring provided at the upper end of the elongated body above the resilient shoulder;

a valve arranged inside of the elongated body for allowing, in use, air to be sucked out of the container;

wherein the elongated body further comprises at least one radially protruding flange element, wherein the resilient shoulder is deformable between a rest position in which the resilient shoulder is undeformed, and a working position in which the resilient shoulder is deformed, when the stopper is positioned in the neck of the container and the inside of the container has a negative pressure, and wherein, in the rest position, peripheral portions of the stop ring and the resilient shoulder are separated from each other, and in the working position, the peripheral portions are collapsed together.

2. The vacuum stopper according to claim 1, wherein the stop ring is positioned approximately level with an upper side of the elongated body.

3. The vacuum stopper according to claim 1, wherein the elongated body is cylindrically shaped.

4. The vacuum stopper according to claim 1, wherein the at least one flange element is provided as a circumferential continuous flange.

5. The vacuum stopper according to claim 1, wherein at least three radially protruding flange elements are provided on the elongated body that are positioned at the same axial position on the elongated body.

6. The vacuum stopper according to claim 1, wherein the at least one radially protruding flange element extends in circumferential direction along the elongated body and/or extends in longitudinal direction along the elongated body.

7. The vacuum stopper according to claim 1, wherein the resilient shoulder is provided of a resilient material and/or of a resilient configuration.

8. The vacuum stopper according to claim 7, wherein the resilient shoulder is hingedly engaged to the elongated body.

9. The vacuum stopper according to claim 1, wherein, in the rest position, the resilient shoulder is biased, such that, when the stopper is engaged in the neck of the container, there is no vacuum in the container, and in the working position, the resilient shoulder seals the neck of the container, such that, when the stopper is engaged in the neck of the container, there is vacuum in the container.

10. The vacuum stopper according to claim 9, wherein, in the rest position, the resilient shoulder is provided with at least one position around which the resilient shoulder can hinge and/or deform from the rest position towards the working position.

11. The vacuum stopper according to claim 1, wherein an upper side of the elongated body is configured to receive a vacuum pump.

12. The vacuum stopper according to claim 1, wherein the elongated body is deformable, in use, under the influence of vacuum, such that the outer diameter of the elongated body at least locally increases.

13. The vacuum stopper according to claim 1, wherein the stop ring is more stiff than the resilient shoulder.

14. The vacuum stopper according to claim 13, wherein the stop ring is more stiff than the elongated body, and the elongated body is more stiff than the resilient shoulder.

15. The vacuum stopper according to claim 1, wherein the diameter of the stop ring is approximately 1.5 times the diameter of the elongated body including the at least one flange element in the rest position.

16. The vacuum stopper according to claim 1, wherein the valve is a one-way valve.

17. The vacuum stopper according to claim 1, wherein the valve is arranged at a position inside of the elongated body such that an upper side of the valve is lower than an upper side of the elongated body.

18. An assembly comprising a container and the vacuum stopper according to claim 1.

19. The assembly of claim 18, wherein the container has a neck provided with screw thread and a screw cap for engagement with the threaded neck, wherein the stopper, in use, is inserted in the neck of the container, and the screw cap fits over the stopper for engagement with the threaded neck.

20. The assembly of claim 18, wherein the vacuum stopper is integrated to a screw cap of the container.

21. The vacuum stopper according to claim 1, wherein, in the working position in which the resilient shoulder is deformed, the resilient shoulder has a height smaller than that in the rest position in which the resilient shoulder is undeformed.

* * * * *